US008417150B2

(12) United States Patent
Kameda

(10) Patent No.: US 8,417,150 B2
(45) Date of Patent: Apr. 9, 2013

(54) FIXING APPARATUS HAVING AN EXTERNAL HEATING BELT NOT IN CONTACT WITH A FIXING MEMBER WHEN AN EXTERNAL HEATING MECHANISM IS RETRACTED FROM THE FIXING MEMBER

(75) Inventor: Seiichiro Kameda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 12/961,641

(22) Filed: Dec. 7, 2010

(65) Prior Publication Data

US 2011/0142496 A1 Jun. 16, 2011

(30) Foreign Application Priority Data

Dec. 14, 2009 (JP) ..... 2009-282851

(51) Int. Cl.
*G03G 15/20* (2006.01)

(52) U.S. Cl.
USPC ..... 399/122

(58) Field of Classification Search ..... 399/122, 399/328
See application file for complete search history.

(56) References Cited

U.S. PATENT DOCUMENTS

| | | | | |
|---|---|---|---|---|
| 7,251,425 | B2 | 7/2007 | Kameda | |
| 7,430,393 | B2 | 9/2008 | Kuroki et al. | |
| 7,603,069 | B2 | 10/2009 | Yamana et al. | |
| 7,890,024 | B2 | 2/2011 | Hirayama et al. | |
| 7,890,038 | B2 | 2/2011 | Chikugo et al. | |
| 7,962,080 | B2 | 6/2011 | Kameda | |
| 2005/0214043 | A1 * | 9/2005 | Kameda | 399/328 |
| 2007/0212094 | A1 * | 9/2007 | Asakura et al. | 399/328 |
| 2007/0217838 | A1 | 9/2007 | Yamana et al. | |
| 2008/0003009 | A1 * | 1/2008 | Minakuchi et al. | 399/69 |
| 2008/0003028 | A1 | 1/2008 | Kuroki et al. | |
| 2008/0317525 | A1 | 12/2008 | Kuroki et al. | |
| 2011/0176823 | A1 | 7/2011 | Kameda | |

FOREIGN PATENT DOCUMENTS

| | | | |
|---|---|---|---|
| JP | 2005241890 A | * | 9/2005 |
| JP | 2008-033228 | | 2/2008 |
| JP | 2009003021 A | * | 1/2009 |
| JP | 2009-069220 | | 4/2009 |

* cited by examiner

*Primary Examiner* — Quana M Grainger
(74) *Attorney, Agent, or Firm* — Fitzpatrick, Cella, Harper & Scinto

(57) ABSTRACT

A fixing apparatus comprising: a fixing member for fixing a toner image onto a recording material; a pressure member for pressing the fixing member to form a nip portion by which the recording material is nipped and conveyed; an external heating mechanism including an external heating belt for heating the fixing member by contacting an outer surface thereof; a retraction mechanism configured to retract the external heating mechanism from the fixing member; and a restricting portion for restricting the external heating belt so that the external heating belt is separated from the fixing member when the external heating mechanism is retracted from the fixing member by the retraction mechanism.

9 Claims, 9 Drawing Sheets

FIXING APPARATUS HAVING AN EXTERNAL HEATING BELT NOT IN CONTACT WITH A FIXING MEMBER WHEN AN EXTERNAL HEATING MECHANISM IS RETRACTED FROM THE FIXING MEMBER

BACKGROUND OF THE INVENTION

1. Field of the Invention

The present invention relates to a fixing apparatus including a fixing member, a pressure member that forms a nip portion with the fixing member to apply pressure to a recording material, and an external heating portion that forms a nip portion through contact with the fixing member, and that has an external heating belt capable of externally heating the fixing member.

2. Description of the Related Art

There has conventionally been known a fixing apparatus having a fixing roller and a pressure roller, wherein the fixing roller includes a heat-generating member incorporated therein. In the configuration in which the heat-generating member is incorporated in the fixing roller, the thermal conductivity of a metal core or an elastic layer of the fixing roller is low, so that heat on the surface of the fixing roller is absorbed to allow the temperature on the surface of the fixing roller to be easy to be reduced during the time when the recording material passes between the fixing roller and the pressure roller. The quantity of heat required for a recording material (thick paper) to fix an image and having a great grammage is greater than the quantity of heat required for a recording material (thin paper) having a small grammage to fix an image, so that, when the recording material (thick paper) having a great grammage passes between the fixing roller and the pressure roller, the temperature on the surface of the fixing roller tends to be reduced. Therefore, toner is defectively fixed on the recording material, which might cause a deterioration in the image quality.

Japanese Patent Application Laid-Open No. 2009-069220 discloses a fixing apparatus as an invention for suppressing the temperature drop on the surface of the fixing roller described above. The fixing apparatus described in Japanese Patent Application Laid-Open No. 2009-069220 includes a fixing roller, a pressure roller, a heating belt of an endless belt type that abuts against the surface of the fixing roller, and a heating roller around which a pressure belt is looped, and that has a halogen lamp incorporated therein. According to this configuration, the heat of the halogen lamp is propagated to the heating roller, the heating belt, and the fixing roller, whereby the temperature drop on the surface of the fixing roller is prevented.

The fixing apparatus described in Japanese Patent Application Laid-Open No. 2009-069220 includes a heating and canceling mechanism that allows the heating belt to be in contact with the fixing roller so as to be capable of heating the heating belt, and that allows the heating belt to be separated from the fixing roller so as to stopl the heating. When the fixing roller has a temperature not less than a predetermined temperature during a warm-up period, the heating belt abuts against the fixing roller. After a power source of a main body of the apparatus is turned off, the heating belt is separated from the fixing roller. With this configuration, a curl formed on the heating belt is corrected, so that the defective rotation of the heating belt is prevented, whereby the defective fixing is prevented to suppress the deterioration in image quality.

However, in the mechanism described in Japanese Patent Application Laid-Open No. 2009-069220, the heat is propagated to the fixing roller from the heating belt immediately before the recording material passes between the fixing roller and the pressure roller, and a problem arises when the heating belt is changed to a contact state in which the heating belt is in contact with the fixing roller from a separated state in which the heating belt is separated from the fixing roller. This problem will be described with reference to FIG. 9.

FIG. 9 is a sectional view illustrating a configuration of a fixing apparatus 300 having a heating and canceling mechanism 350 described in Japanese Patent Application Laid-Open No. 2009-069220. As illustrated in FIG. 9, in the fixing apparatus 300, a fore part of a heating belt 383 is brought into contact with a rotating fixing roller 360, but two rollers 381 and 382 are not abutted thereagainst during the change from the separated state to the contact state.

In the state in which the fore part of the heating belt 383 is in contact with the fixing roller 360, but the two rollers 381 and 382 are not abutted against the fixing roller 360 as described above, the heating belt 383 is not driven with the fixing roller 360, whereby the heating belt 383 and the fixing roller 360 are in sliding friction with each other. With the sliding friction, sliding-friction damage is produced on the surface of the heating belt 383 and the surface of the fixing roller 360. This sliding-friction damage can cause a deterioration of toner gloss (glaze), and toner or powders of the recording material can suffer sliding-friction damage, which might cause a deterioration in the image quality. Further, once the sliding-friction damage occurs, it is easy for the toner and powders of the recording material to acculumulate the sliding-friction damage, with the result that damage, which appears on an image, might be formed on the surface of the fixing roller at an accelerated rate.

The present invention aims to provide a fixing apparatus that can reduce a sliding friction between an external heating belt and a fixing member.

SUMMARY OF THE INVENTION

A fixing apparatus comprises: a fixing member for fixing a toner image onto a recording material; a pressure member for pressing the fixing member to form a nip portion by which the recording material is nipped and conveyed; an external heating mechanism, including a belt member, for heating an outer surface of the fixing member to heat the fixing member; a separation/contact portion which allows the fixing member and the external heating belt to abut each other or to be separated from each other; and a restricting portion for restricting the external heating belt such that the belt is not in contact with the fixing member when the external heating mechanism is retracted from the fixing member.

Further features of the present invention will become apparent from the following description of exemplary embodiments with reference to the attached drawings.

DESCRIPTION OF THE EMBODIMENTS

In the following, exemplary embodiments of the present invention will be described in detail in an exemplified manner with reference to the drawings. Here, dimensions, materials, shapes, relative arrangements thereof and the like described in the following embodiment are to be appropriately modified according to a configuration of an apparatus to which the present invention is applied and various conditions. Therefore, unless otherwise specified, the scope of the present invention is not to be limited thereto.

First Embodiment

Figure 1:
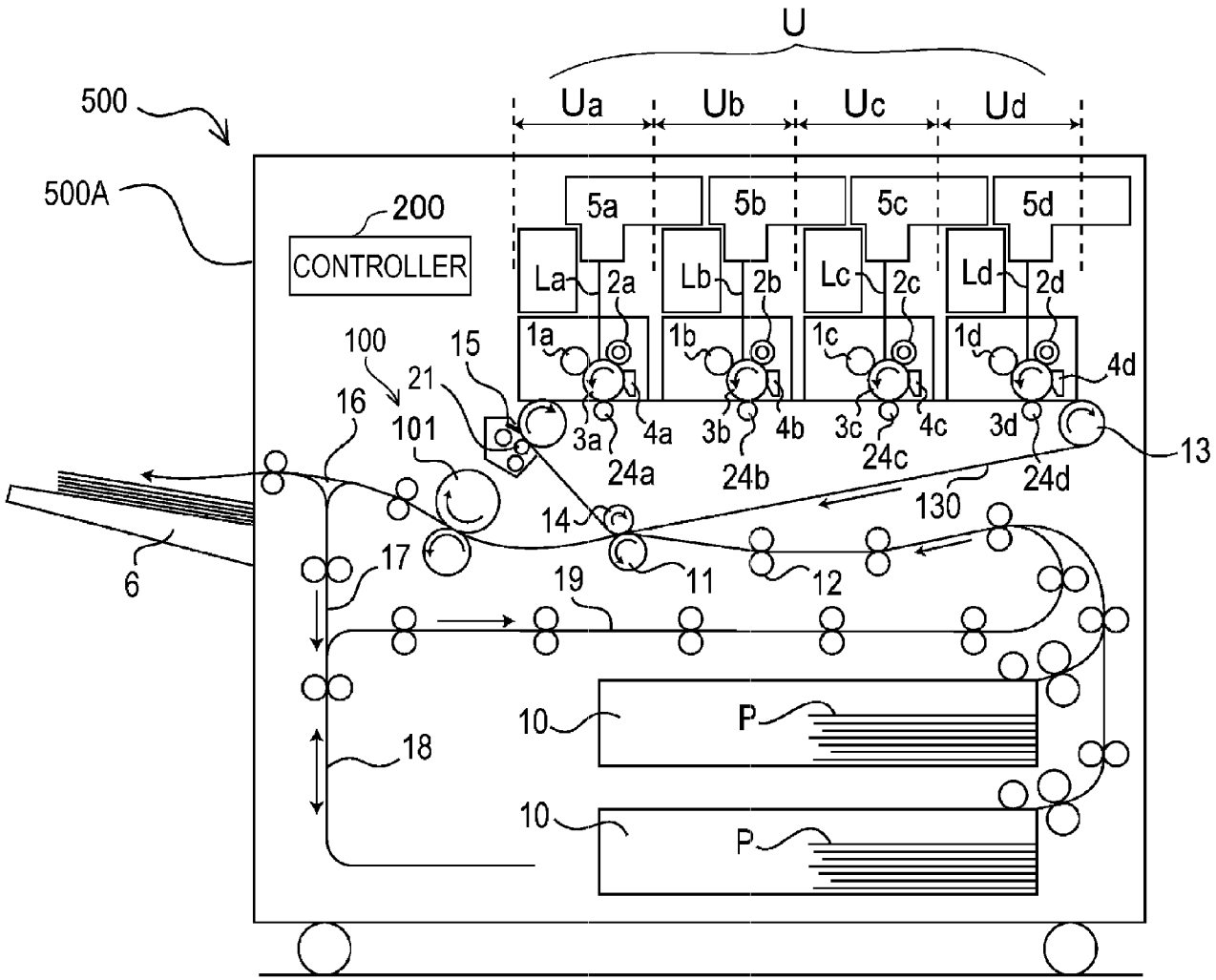
FIG. 1 is a sectional view illustrating a configuration of an image forming apparatus according to a first embodiment of the present invention.

FIG. 1 is a sectional view illustrating a configuration of an image forming apparatus 500 according to a first embodiment of the present invention. The image forming apparatus 500 is a tandem-type color laser beam printer using a transfer-type electrophotographic process. As illustrated in FIG. 1, the image forming apparatus 500 has an image forming apparatus main body (hereinafter, referred to as the apparatus main body) 500A, and image forming portions U (Ua, Ub, Uc, Ud) for forming an image onto a sheet provided in the apparatus main body 500A. The image forming portions U (Ua, Ub, Uc, Ud) include, respectively, photosensitive drums (3*a*, 3*b*, 3*c*, 3*d*) serving as an "image bearing member", and primary transfer chargers (24*a*, 24*b*, 24*c*, 24*d*) serving as "transfer apparatus". At least the photosensitive drums may be included in a process cartridge, and it may be incorporated into the apparatus main body 500A as the process cartridge.

As described above, four "image forming portions", which are the first image forming portion Ua, the second image forming portion Ub, the third image forming portions Uc, and the fourth image forming portion Ud, are arranged side by side in the apparatus main body 500A, wherein a toner image of a different color is formed through a process of a formation of an electrostatic latent image, developing, and transfer. The image forming portions Ua, Ub, Uc, and Ud respectively include the electrophotographic photosensitive drums (each of which is hereinafter merely referred to as a "photosensitive drum") 3*a*, 3*b*, 3*c*, and 3*d* serving as the dedicated "image bearing member". A toner image of each color is formed on each of the photosensitive drums 3*a*, 3*b*, 3*c*, and 3*d*. An intermediate transfer belt 130 serving as an "intermediate transfer member" is arranged adjacent to the photosensitive drums 3*a* to 3*d*, wherein the toner image of each color formed on each of the photosensitive drums 3*a* to 3*d* is primarily transferred onto the intermediate transfer belt 130, and transferred onto a recording material P at a secondary transfer portion. The toner image is fixed onto the recording material P having the toner image transferred thereon through the application of heat and pressure by a fixing apparatus 100, and the recording material P is discharged onto a discharge tray 6 at the outside of the apparatus as a recording-image formed material.

Drum chargers 2*a*, 2*b*, 2*c*, and 2*d*, development devices 1*a*, 1*b*, 1*c*, and 1*d*, primary transfer chargers 24*a*, 24*b*, 24*c*, and 24*d*, and cleaners 4*a*, 4*b*, 4*c*, and 4*d* are respectively provided on outer peripheries of the photosensitive drums 3*a*, 3*b*, 3*c*, and 3*d*. Laser scanners 5*a*, 5*b*, 5*c*, and 5*d* are provided at the upper portion of the apparatus main body 500A.

The photosensitive drums 3*a* to 3*d* are driven to rotate in a counterclockwise direction indicated by an arrow, wherein their peripheral surfaces are uniformly primarily charged to have a predetermined polarity and potential by the drum chargers 2*a* to 2*d*, respectively. The uniformly charged surface of the photosensitive drums 3*a* to 3*d* are scanned and exposed, respectively, to laser beams output from the laser scanners 5*a* to 5*d*, which are modulated according to respective image signal signals, whereby electrostatic latent images according to the image signals are respectively formed on the photosensitive drums 3*a* to 3*d*. Each of the laser scanners 5*a* to 5*d* includes a light source device, polygon mirror, and the like. The laser beam emitted from each light source device is scanned by the rotation of its respective polygon mirror, and the light flux of the scanned light is deflected by its respective reflection mirror to be converged onto a bus line of its respective photosensitive drum by a fθ lens, whereby one of the exposures La, Lb, Lc, and Ld is performed. Thus, an electrostatic latent image according to the image signal is formed on each of the photosensitive drums 3*a* to 3*d*.

A predetermined amount of toner of cyan, magenta, yellow, and black serving as a developer, respectively, are supplied and filled in the development devices 1*a*, 1*b*, 1*c*, and 1*d* by an unillustrated supplying device. The development devices 1*a*, 1*b*, 1*c*, and 1*d* respectively develop the electrostatic latent images on the photosensitive drums 3*a*, 3*b*, 3*c*, and 3*d* to make the electrostatic latent images visible as a cyan toner image, a magenta toner image, a yellow toner image, and a black toner image.

The intermediate transfer belt 130 is looped around three rollers 13, 14, and 15, and it is driven to rotate in the direction (clockwise direction) of an arrow with the same peripheral velocity as that of the photosensitive drums 3*a*, 3*b*, 3*c*, and 3*d*. The yellow toner image, which is the first color, is carried on the photosensitive drum 3*a* in the first image forming portion Ua. The yellow toner image of the first color is primarily transferred onto the outer peripheral surface of the intermediate transfer belt 130 by an electric filed forming a primary transfer bias applied to the intermediate transfer belt 130 during the time when it passes through the nip portion between the photosensitive drum 3*a* and the intermediate transfer belt 130. Similarly, the magenta toner image of the second color, the cyan toner image of the third color, and the black toner image of the fourth color are carried on the photosensitive drums 3*b*, 3*c*, and 3*d* in the second, third, and fourth image forming portions Ub, Uc, and Ud, respectively. The magenta toner image of the second color, the cyan toner image of the third color, and the black toner image of the fourth color are successively superimposed and transferred onto the intermediate transfer belt 130. Then, a composite color toner image corresponding to the target color image is formed on the intermediate transfer belt 130.

A secondary transfer roller 11 presses the intermediate transfer belt 130 as nipping the same together with the roller 14 of the three rollers 13, 14 and 15 around which the intermediate transfer belt 130 is looped, whereby a secondary transfer nip portion is formed between the intermediate transfer belt 130 and the secondary transfer roller 11. On the other hand, the recording material P is separated one by one and fed from a sheet cassette 10, and waits for a predetermined time at a registration roller 12, serving as a recording-material conveying portion. Thereafter, the conveyance of the recording material P is started at a predetermined timing at which the recording material P is to receive the image on the intermediate transfer belt 130. The recording material P passes through a pretransfer guide to be fed to the secondary transfer nip portion, which is an abutment nip between the intermediate transfer belt 130 and the secondary transfer roller 11, at a predetermined timing. The composite color toner image superimposed and transferred onto the intermediate transfer belt 130 is secondary transferred onto the recording material P at one time by a secondary transfer bias applied from a secondary transfer bias power source.

The recording material P on which the composite color toner image is transferred at the secondary nip portion is separated from the intermediate transfer belt 130 to successively be guided to the fixing apparatus, wherein the toner image is fixed by applying heat and pressure to the recording material P.

The remaining toners after the transfer on the photosensitive drums 3*a*, 3*b*, 3*c*, and 3*d* on which the primary transfer is completed are cleaned and removed by the corresponding cleaners 4*a*, 4*b*, 4*c*, and 4*d*, in order to prepare the next formation of the electrostatic latent image. The remaining toner and other foreign materials on the intermediate transfer belt 130 are brushed away by abutting a cleaning web (nonwoven cloth) 21 against the surface of the intermediate transfer belt 130.

When a duplex copy mode is selected, the recording material P, which is discharged from the fixing apparatus 100 and has a first surface having an image formed thereon is introduced to a sheet path 17 at a re-circulation conveyance mechanism by a flapper (changeover member) 16. The recording material P then enters a switchback sheet path 18, and then, is drawn and conveyed from the switchback sheet path 18 to be guided to a re-conveyance sheet path 19. The recording material P passes from the re-conveyance sheet path 19 through the registration roller 12 and the pretransfer guide, and is again introduced to the secondary transfer nip portion, which is the abutment nip between the intermediate transfer belt 130 and the secondary transfer roller 11, at a predetermined timing with the first surface being upside down. Thus, the toner image on the intermediate transfer belt 130 is secondary transferred onto the second surface of the recording material P. The recording material P, on which the secondary transfer of the toner image is performed on the second surface at the secondary nip portion, is separated from the intermediate transfer belt 130 to be again guided to the fixing apparatus 100, whereby the fixing process of the toner image is executed, and the recording material P is discharged onto the discharge tray 6 at the outside of the apparatus as a duplex copy.

The image forming apparatus 500 includes a controller 200 that controls the driving of the image forming portions Ua to Ud and other devices in the apparatus main body 500A. The controller 200 can control the drive of a separation/contact or retraction unit 170*b* as described later (see FIG. 3).

In the case of a color image, toner of multiple colors forms two to four layers, so that an electrophotographic image forming apparatus capable of forming a color image has a feature different from an apparatus for a monochrome image with respect to toner. Specifically, the toner is required to have excellent melting performance and color-mixture performance upon the application of heat, so that toner of a sharp-melt type having low softening point and low melt viscosity is used. With the use of the sharp melt toner, a color copy having the wide color reproduction range of a transcript can be obtained. The sharp melt toner described above is formed by melting, mixing, pulverizing, and sorting toner-forming materials, such as binder resin of polyester resin, styrene-acryl ester resin, etc., a coloring agent (dye, sublimation dye), or charge control agent.

Figure 2:
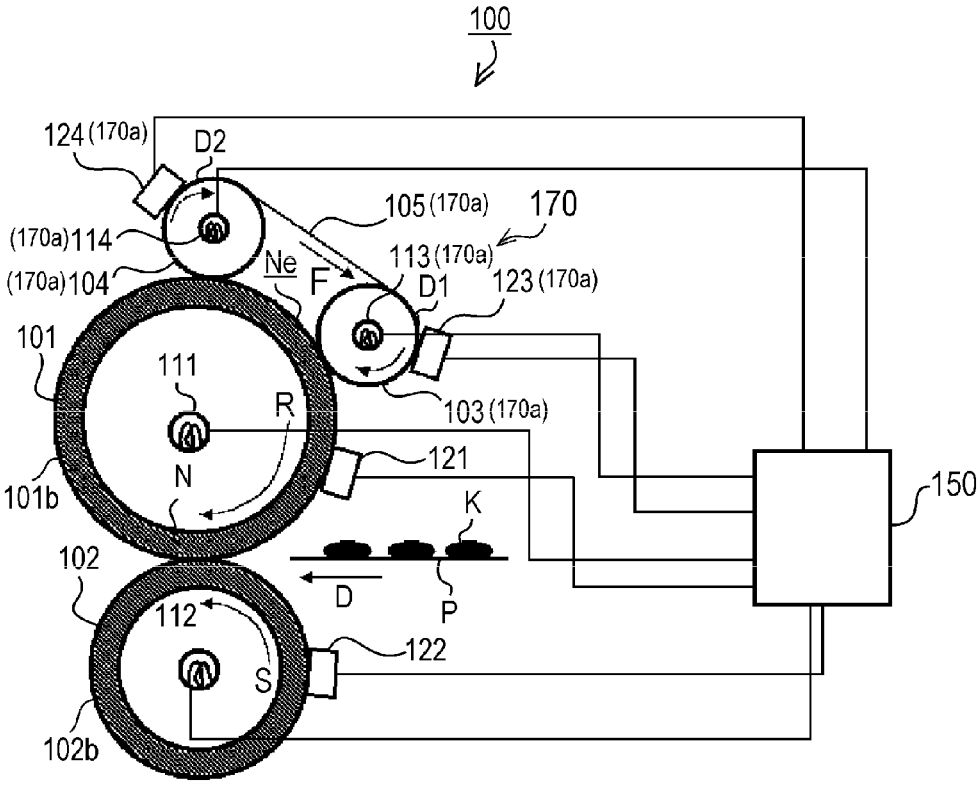
FIG. 2 is a sectional view illustrating a configuration of a fixing apparatus.

FIG. 2 is a sectional view illustrating the configuration of the fixing apparatus 100. As illustrated in FIG. 2, the fixing apparatus 100 includes a fixing roller 101 that serves as a "fixing member" to fix a toner image onto the recording material P, and a pressure roller 102 that serves as a "pressure member" to form a nip portion with the fixing roller 101 and apply pressure to the recording material P. The fixing apparatus 100 further includes the heating and canceling mechanism 170. The heating and canceling mechanism 170 includes a heating unit 170*a* serving as an "external heating portion", a separation/contact unit 170*b* (see FIG. 3A), serving as a "separation/contact portion", and a belt holding roller 55 (see FIGS. 3A and 3B) serving as a "restricting portion" above the fixing roller 101.

The fixing roller 101 is driven to rotate by an unillustrated drive source in the direction of an arrow R with a predetermined velocity, e.g., a peripheral velocity of 500 mm/sec. The fixing roller 101 has a metal core having a cylindrical shape with an outer diameter of 74 mm, a thickness of 6 mm, and a length of 350 mm, and is made of a metal (in the present embodiment, made of an aluminum). A silicone rubber (in the present embodiment, having JIS-A hardness of 20 degrees) covers the metal core with a thickness of 3 mm as a heat-resistant elastic layer. A fluorine resin (in the present embodiment, a PFA tube) serving as a heat-resistant toner parting layer covers the elastic layer with a thickness of 100 μm in order to enhance toner parting properties of the roller A halogen heater 111 having a rated power of 1200 W is arranged as a heat-generating member, for example, in the metal core of the fixing roller 101, whereby the fixing roller 101 is heated from the inside so as to have a predetermined surface temperature. The surface temperature of the fixing roller 101 is detected by a thermistor 121 that is in contact with the fixing roller 101 and serves as a temperature detecting portion. A heater control unit 150 serving as a "temperature control (adjusting) portion" turns ON or OFF the halogen heater 111 based on the detected temperature, whereby the fixing roller 101 is controlled to have a predetermined target temperature, e.g., 200° C.

The pressure roller 102 is pressed against the fixing roller 101 with a predetermined pressure by an unillustrated pressure portion so as to form the fixing nip portion N with the fixing roller 101, and is rotated with the fixing roller 101 in the direction of an arrow S with a predetermined velocity, e.g., a peripheral velocity of 500 mm/sec. The pressure roller 102 has a metal core having a cylindrical shape with an outer diameter of 54 mm, a thickness of 5 mm, and a length of 350 mm, and is made of a metal (in the present embodiment, made of an aluminum). A silicone rubber (in the present embodiment, having JIS-A hardness of 15 degrees) covers the metal core with a thickness of 3 mm as a heat-resistant elastic layer. A fluorine resin (in the present embodiment, a PFA tube) serving as a heat-resistant toner parting layer covers the elastic layer with a thickness of 100 μm in order to enhance toner parting properties of the roller. A halogen heater 112 having a rated power of 300 W is arranged as a heat-generating member, for example, in the metal core of the pressure roller 102, whereby the pressure roller 102 is heated from the inside so as to have a predetermined surface temperature. The surface temperature of the pressure roller 102 is detected by a thermistor 122 that is in contact with the pressure roller 102 and serves as a temperature detecting portion. The heater control unit 150 turns ON or OFF the halogen heater 112, whereby the pressure roller 102 is controlled to have a predetermined target temperature, e.g., 130° C.

The non-fixed toner K carried on the recording material P is passed through the fixing nip portion N so as to fix the toner K onto the recording material P. Specifically, the recording material P carrying the non-fixed toner K thereon is nipped at the fixing nip portion N, and heat is applied thereto to fix the toner K.

The configuration of the heating unit 170*a* will next be described. The schematic main configuration of the heating unit 170*a* will firstly be described. The heating unit 170*a* includes halogen heaters 113 and 114 serving as "heat-generating members". The heating unit 170*a* also includes a first heating roller 103 having the halogen heater 113 provided therein and a second heating roller 104 having the halogen heater 114 provided therein. The heating unit 170*a* also includes an external heating belt 105 that forms the nip portion through the contact to the fixing roller 101 and can externally heat the fixing roller 101 due to the heat propagation from the halogen heaters 113 and 114. The external heating belt 105 is wound around the first heating roller 103 and the second heating roller 104, wherein the heat from the first heating roller 103 and the second heating roller 104 is supplied to the external heating belt 105.

As illustrated in FIG. 2, the external heating belt 105 is arranged on the outer peripheral surface of the fixing roller 101. Since the first heating roller 103 and the second heating roller 104, which stretch the external heating belt 105, are pressed against the fixing roller 101 with a predetermined pressure, the external heating belt 105 forms an abutment nip portion Ne with the fixing roller 101. The external heating belt 105 is configured to be capable of abutting against the fixing roller 101 and to be capable of retracting therefrom. The external heating belt 105 rotates in the direction of an arrow F with a predetermined velocity, e.g., with a peripheral velocity of 500 mm/sec with the fixing roller 101. Specifically, the external heating belt 105 heats the fixing roller 101 as being in contact with the outer surface of the fixing roller 101.

The first heating roller 103 that stretches the external heating belt 105 is a support roller arranged at the downstream side of the fixing roller 101 in the rotating direction. The first heating roller 103 has a metal core having a cylindrical shape with an outer diameter of 30 mm, a thickness of 3 mm, and a length of 350 mm, and is made of a metal (in the present embodiment, made of an aluminum). A fluorine resin (in the present embodiment, a PFA tube) serving as a heat-resistant sliding layer covers the metal core with a thickness of 20 μm in order to prevent the abrasion between the inner surface of the external heating belt 105 and the metal core. The halogen heater 113 having a rated power of 1000 W is arranged as a "first heat-generating member" that is a "heat-generating member", for example, in the metal core of the first heating roller 103, whereby the external heating belt 105 is heated from the inside so as to have a predetermined surface temperature. The surface temperature of the external heating belt 105 is detected by a thermistor 123 that serves as a temperature detecting portion and is in contact with a first contact region D1 between the first heating roller 103 and the external heating belt 105. The heater control unit 150 turns ON or OFF the halogen heater 113 based on the detected temperature, whereby the external heating belt 105 is controlled (adjusted) to have a predetermined target temperature, e.g., 220° C.

The second heating roller 104 that stretches the external heating belt 105 is arranged at the upstream side of the fixing roller 101 in the rotating direction with a configuration that is substantially the same as that of the first heating roller 103. The second heating roller 104 is also in contact with the inner surface of the external heating belt 105 to heat the external heating belt 105. Therefore, the second heating roller 104 heats the region of the external heating belt 105 that is heated by the first heating roller 103. The second heating roller 104 has a metal core having a cylindrical shape with an outer diameter of 30 mm, a thickness of 3 mm, and a length of 350 mm, and is made of a metal (in the present embodiment, made of an aluminum). A fluorine resin (in the present embodiment, a PFA tube) serving as a heat-resistant sliding layer covers the metal core with a thickness of 20 μm in order to prevent the abrasion between the inner surface of the external heating belt 105 and the metal core. The halogen heater 114 having a rated power of 1000 W is arranged as a "second heat-generating member" that is a "heat-generating member", for example, in the metal core of the second heating roller 104, whereby the external heating belt 105 is heated from the inside so as to have a predetermined surface temperature.

The external heating belt 105 has a metallic base material having an outer diameter of 60 mm, a thickness of 50 μm, and a length of 350 mm. A fluorine resin (in the present embodiment, a PFA tube) serving as a heat-resistant sliding layer covers the base material with a thickness of 20 μm in order to prevent the deposition of toner. The surface temperature of the external heating belt 105 is detected by a thermistor 124 that serves as a temperature detecting portion and is in contact with a second contact region D2 between the second heating roller 104 and the external heating belt 105. The heater control unit 150 turns ON or OFF the halogen heater 114 based on the detected temperature, whereby the external heating belt 105 is controlled (adjusted) to have a predetermined target temperature, e.g., 220° C. The reason why the target temperature of the external heating belt 105 is set to be higher than the target temperature of the fixing roller 101 is based on the reason described below. Specifically, when the temperature of the external heating belt 105 is kept to be a temperature higher than the temperature of the fixing roller 101, heat is applied to the fixing roller 101 from the external heating belt 105 with a good response (thermal sensitivity) with respect to the drop of the surface temperature of the fixing roller 101 due to the recording material P.

Figure 3A:
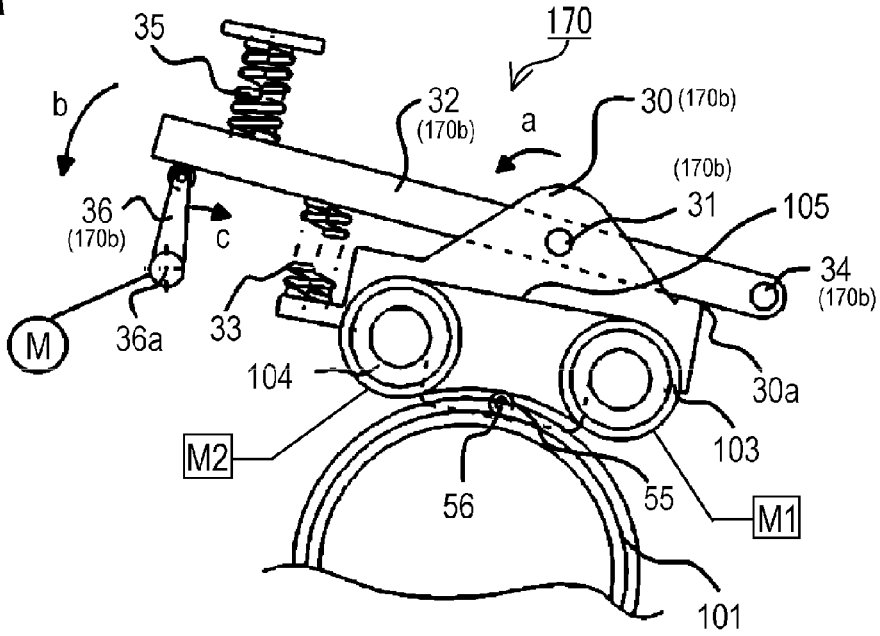
FIG. 3A is a sectional view and FIG. 3B is an enlarged sectional view illustrating a configuration of a heating and canceling mechanism.

FIG. 3A is an enlarged sectional view illustrating the configuration of the heating and canceling mechanism 170. FIG. 3A illustrates the state in which the external heating belt 105 is separated from the fixing roller 101. As illustrated in FIG. 3A, the heating and canceling mechanism 170 includes the separation/contact unit 170*b* that serves as the "separation/contact portion" for allowing the fixing roller 101 and the external heating belt 105 to be separated from each other and to be in contact with each other. The separation/contact unit 170*b* is brought into contact with the fixing roller 101 as pressing the fixing roller 101, so that it functions as a "pressure portion" or "contact portion", while when it is separated from the fixing roller 101 it functions to cancel the pressure, so that it functions as a "pressure-canceling portion" and a "separating portion". The first heating roller 103 and the second heating roller 104 are rotatably supported by a support frame 30 via unillustrated insulating bush and bearing at both ends thereof in the longitudinal direction. A flange of the insulating bush is formed to be greater than the outer diameter of the first heating roller 103 and the second heating roller 104, whereby it functions as a movement restricting member of the external heating belt 105 in the longitudinal direction of the roller.

Although described later, the separation/contact unit 170*b* includes the support frame 30, an arm 32, a heating/pressing spring 35, a spring 33, a pressure-canceling arm 36, and the like. The support frame 30 is supported, so as to be capable of swinging, with respect to the arm 32 by a support shaft 31 at both ends of the front surface and the back surface as illustrated in FIG. 3A. A force is applied to the support frame 30 to swing in the direction of an arrow a about the support shaft 31 by the spring 33. In the state in which the first heating roller 103 and the second heating roller 104 are separated from the fixing roller 101 as illustrated in FIG. 3A, an abutting portion 30*a* formed on the support frame 30 abuts against the arm 32.

The arm 32 is provided so as to be capable of swinging about a support shaft 34 with respect to a frame of the fixing apparatus not illustrated. The heating/pressing spring 35 that applies force to move the arm 32 down is provided at the free end of the arm 32. Therefore, a force is applied to the arm 32 to swing in the direction of an arrow b about the support shaft 34.

The pressure-canceling arm 36 that is a part of the "separation/contact portion" is provided below the free end of the arm 32 so as to be capable of swinging about a swing shaft 36*a*. The pressure-canceling arm 36 can allow the external heating belt 105 to be separated from the fixing roller 101 and can allow the external heating belt 105 to be in contact with the fixing roller 101. When the leading end of the pressure-canceling arm 36 is directed upward, the leading end of the pressure-canceling arm 36 abuts against the free end of the arm 32.

As illustrated in FIG. 3A, the heating and canceling mechanism 170 includes the belt holding roller 55 serving as a "belt holding member" that is the "restricting portion". Specifically, the belt holding roller 55 serving as the "restricting portion" is provided below the external heating belt 105. The belt holding roller 55 serving as the "restricting portion" acts as described below when the fixing roller 101 is separated from the external heating belt 105 by the drive of the separation/contact unit 170*b*. Specifically, the belt holding roller 55 supports the heating unit 170*a* in order that the external heating belt 105 holds the shape of the abutment nip portion Ne that is the "shape of the nip portion". More specifically, the belt holding roller 55 holds the shape of the external heating belt 105 in such a manner that the portion of the external heating belt 105 that is opposite to the fixing roller 101 keeps the shape of the abutment nip portion Ne. The belt holding roller 55 is a member that supports the external heating belt 105 from below as abutting against the external heating belt 105 from the side of the fixing roller 101. The belt holding roller 55 is a roller-like member that abuts against the external heating belt 105.

When the external heating belt 105 is separated from the fixing roller 101, the external heating belt 105 is stretched by the first heating roller 103, the second heating roller 104, and the belt holding roller 55 provided at the support frame 30. The external heating belt 105 can keep the shape of the abutment nip portion Ne by stretching the external heating belt 105 by the belt holding roller 55.

A roller shaft 56 is mounted to the support frame 30, wherein the belt holding roller 55 can rotate about the roller shaft 56. The belt holding roller 55 holds both ends of the external heating belt 105 in the longitudinal direction. Since the external heating belt 105 keeps the shape of the abutment nip portion Ne, the retracting amount of the external heating belt 105 from the fixing roller 101 can be set to be small.

Figure 3B:
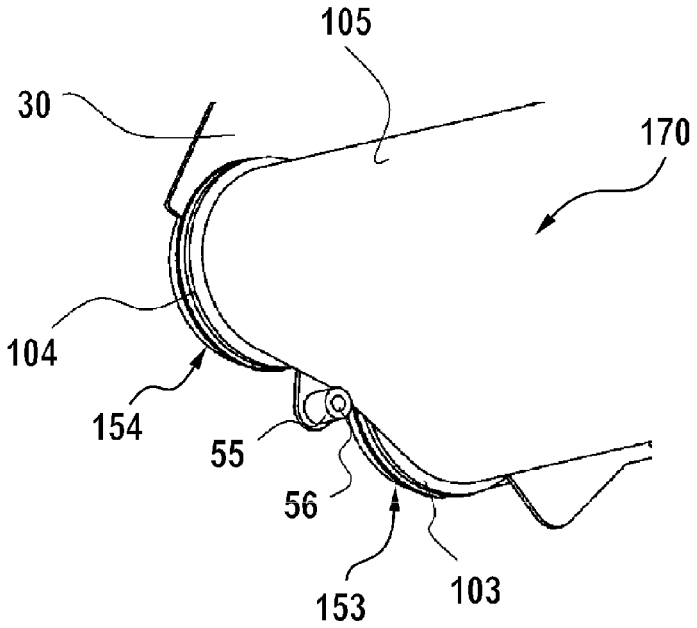

FIG. 3B is an enlarged sectional view illustrating the configuration of the heating and canceling mechanism 170. FIG. 3B illustrates the state in which the external heating belt 105 is separated from the fixing roller 101. As illustrated in FIG. 3B, the external heating belt 105 is looped around the first heating roller 103 and the second heating roller 104, which are arranged parallel to each other, and the belt holding roller 55 is arranged between the first heating roller 103 and the second heating roller 104 at the outside of the external heating belt 105. The belt holding roller 55 holds the end part of the external heating belt 105 in the width direction. The fixing roller 101 is arranged below the external heating belt 105, wherein the external heating belt 105 and the fixing roller 101 have to be capable of freely being in contact with each other and being separated from each other. Therefore, the belt holding roller 55 is not arranged all over the width direction of the external heating belt 105 in order not to hinder the contact and separation described above.

As described above, when the belt holding roller 55 holds the external heating belt 105, the external heating belt 105 is surely separated from the fixing roller 101, whereby the direct heat propagation from the external heating belt 105 to the fixing roller 101 is cut. The first heating roller 103 has an offset restricting plate 153 that restricts the position of the rotation of the external heating belt 105 at both ends thereof in the longitudinal direction. The second heating roller 104 has an offset restricting plate 154 that restricts the position of the rotation of the external heating belt 105 at both ends thereof in the longitudinal direction.

Figure 4A:
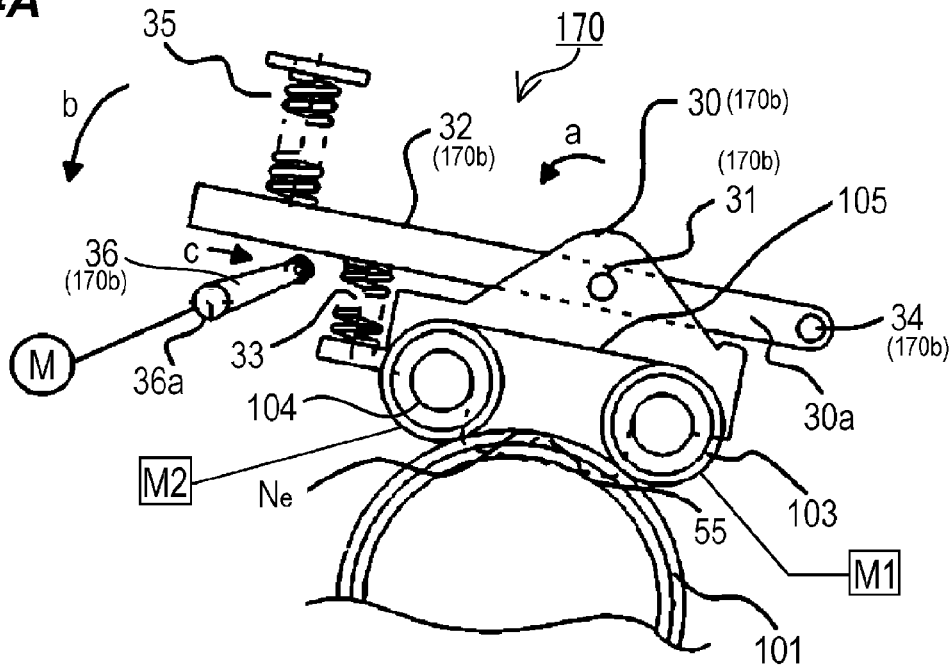
FIG. 4A is a sectional view and FIG. 4B is an enlarged sectional view illustrating a configuration of a heating and canceling mechanism.
Figure 4B:
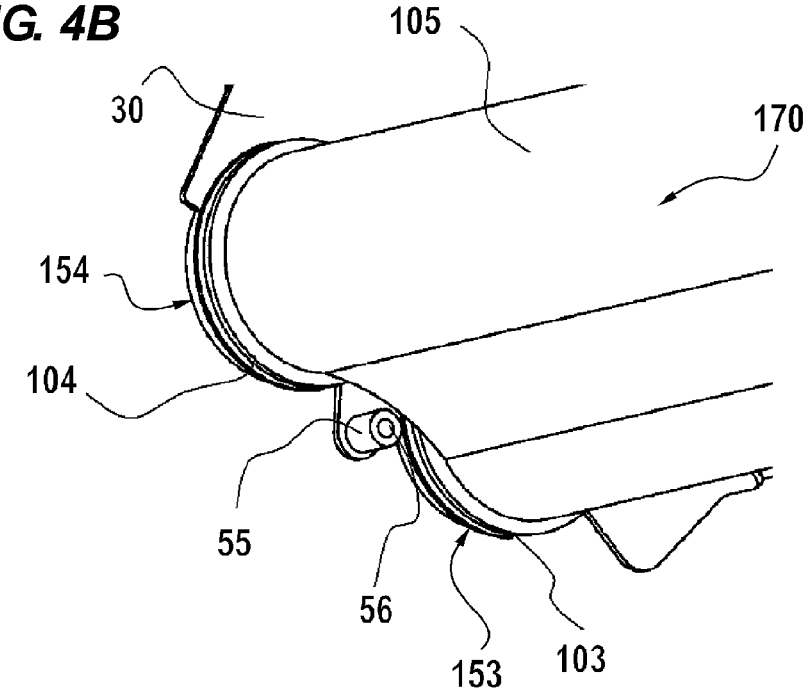

FIG. 4A is an enlarged sectional view illustrating the configuration of the heating and canceling mechanism 170. FIG. 4A illustrates the state in which the external heating belt 105 is in contact with the fixing roller 101. As illustrated in FIG. 4B, in the state in which the external heating belt 105 abuts against the fixing roller 101, the external heating belt 105 is pressed against the fixing roller 101 by the first heating roller 103 and the second heating roller 104 due to the heating/pressing spring 35 and the spring 33. The first heating roller 103 and the second heating roller 104 are in pressed contact with the fixing roller 101 with a total pressure of about 98 N (about 10 kg), and the external heating belt 105 rotates with the rotation of the fixing roller 101. The abutment nip portion Ne (contact length) between the external heating belt 105 and the fixing roller 101 can be formed. When the external heating belt 105 is in contact with (abuts against) the fixing roller 101 by the drive of the separation/contact unit 170*b*, the belt holding roller 55 serving as the "restricting portion" is separated from the external heating belt 105 by the operation of the support frame 30.

FIG. 4B is an enlarged sectional view illustrating the configuration of the heating and canceling mechanism 170. FIG. 4B illustrates the state in which the external heating belt 105 is in contact with the fixing roller 101. As illustrated in FIG. 4B, in the state in which the external heating belt 105 is lowered to the fixing roller 101, the lower part of the external heating belt 105 becomes hollow since it is pushed up by the fixing roller 101. With this, the external holding roller 55 is separated from the external heating belt.

The configuration described with reference to FIGS. 3A and 4A can briefly be said as follows. When the pressure-canceling arm 36 is separated from the arm 32 as illustrated in FIG. 4A, the external heating belt 105 presses the fixing roller 101. Since the position of the belt holding roller 55 to the support frame 30 is not changed, the external heating belt 105 climbs onto the fixing roller 101, whereby the belt holding roller 55 is separated from the external heating belt 105.

When the pressure-canceling arm 36 pushes up the arm 32 as illustrated in FIG. 3A, the external heating belt 105 is separated from the fixing roller 101. Since the position of the belt holding roller 55 to the support frame 30 is not changed as described above, the external heating belt 105 is separated from the fixing roller 101, whereby the external heating belt 105 climbs onto the belt holding roller 55.

The pressure-canceling arm 36 is swung by a motor M that is a "driving device" controlled by a controller 200 that is a "control apparatus". The motor M is configured by utilizing a spring clutch or is a motor that is constructed by a known technique. Since the pressure-canceling arm 36 swings by the driving force of the motor M to move the belt holding roller 55, it can be said that the pressure-canceling arm 36 of the separation/contact unit 170*b* and the belt holding roller 55 are driven by the driving force of the motor M serving as a "swing portion (swing apparatus)" that is the same "driving device".

Next, the operation of the external heating belt 105 from the separation state to the press-contact state will be described with reference to FIGS. 3A and 4A. FIG. 3A illustrates the state in which the external heating belt 105 is separated from the fixing roller 101, i.e., the stand-by state (stand-by state for the image formation). From this state, an image-formation starting signal is input to the image forming apparatus 500. When the image forming apparatus is used as a copying machine, the image-formation starting signal is input by depressing a start button on an operation portion such as a liquid crystal. When the image forming apparatus 500 is used as a printer that is connected through a network with an external device such as a personal computer, the signal may be input according to a print command from the external device. When the signal described above is input, an image-formation preparing operation of various image forming devices in the image forming apparatus 500 is started, wherein the fixing-preparation operation of the fixing apparatus 100 is also started.

When the fixing-preparation operation is started, and the temperatures of the fixing roller 101, the pressure roller 102, the first heating roller 103, and the second heating roller 104 reach the temperatures sufficient for starting the fixing operation, the fixing operation is started. In the present embodiment, it is configured such that the fixing operation is started based on the image-exposure-start timing of the fourth image forming portion Ud to the photosensitive drum 1*d*. More specifically, it is controlled such that an operation of an attaching/detaching mechanism is started after a predetermined time has elapsed from the exposure-start timing of the fourth image forming portion Ud to the photosensitive drum 1*d*.

The conveyance timing of the recording material P to the secondary transfer portion of the intermediate transfer belt 130, i.e., the conveyance-start timing of the registration roller 12, is made based on the image exposure-start timing. The pressure-canceling arm 36 swings in the direction of an arrow c to swing the arm 32 in the direction of the arrow b, whereby the support frame 30, i.e., the external heating belt 105, starts to move toward the fixing roller 101.

When the second heating roller 104 firstly abuts against the fixing roller 101, and the pressure-canceling arm 36 swings in the direction of the arrow c, the support frame 30 swings in the direction reverse to the direction of the arrow a about the support shaft 31. Then, the first heating roller 103 also abuts against the fixing roller 101, whereby the external heating belt 105 is pressed and abutted against the fixing roller 101. Thus, the pressure operation is completed. In the state in FIG. 4A, the first heating roller 103 and the second heating roller 104 are pressed against the fixing roller 101 by the heating/pressing spring 35 and the spring 33.

The controller 200 allows the pressure-canceling arm 36 to swing in the direction of the arrow c by the motor M upon the start of the fixing operation, so as to execute the operation from FIG. 3A to FIG. 4A. Upon the completion of the fixing operation, the controller 200 allows the pressure-canceling arm 36 to swing in the direction reverse to the direction of the arrow c by the motor M, so as to execute the operation from FIG. 4A to FIG. 3A. The controller 200 returns the state to the one illustrated in FIG. 3A at the beginning, i.e., the state in which the external heating belt 105 is separated from the fixing roller 101, and keeps this state until the start of the next fixing operation.

During the stand-by state, the pressure roller 102, the first heating roller 103, and the second heating roller 104 are separated from the fixing roller 101 in order to prevent the deformation or distortion of the elastic layer 101*b* of the fixing roller 101 and the elastic layer 102*b* of the pressure roller 102. In the configuration in which the rollers are not separated but in press contact with each other during the stand-by state, the deformation or the distortion of the elastic layer at the fixing nip portion N and the abutment nip portion Ne remains during the printing operation, resulting in the production of lateral streaks or gloss streaks (unevenness) on an image to cause a deterioration in image quality. Therefore, the rollers are separated from each other during the stand-by state.

Figure 5A:
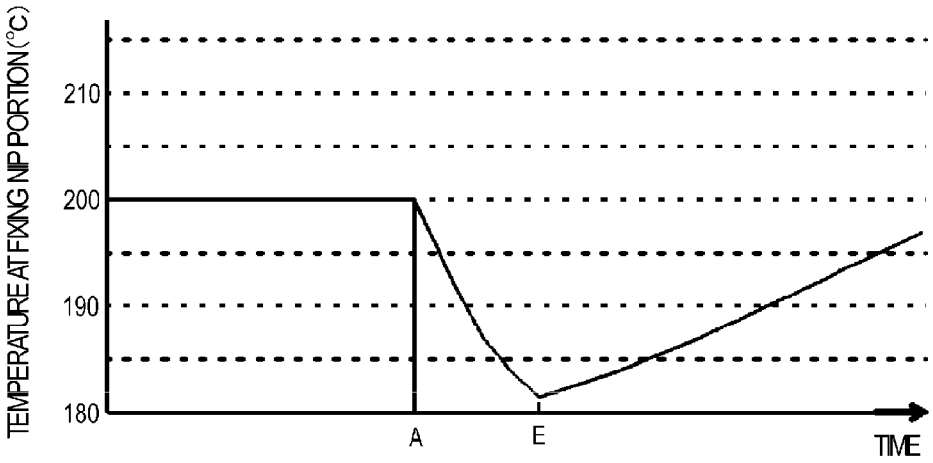
FIGS. 5A and 5B are graphs respectively illustrating a change in a surface temperature of a fixing roller before and after a thick recording material passes through a fixing nip, with respect to the case in which a heating belt is not provided, and to the case in which the heating belt is provided.
Figure 5B:
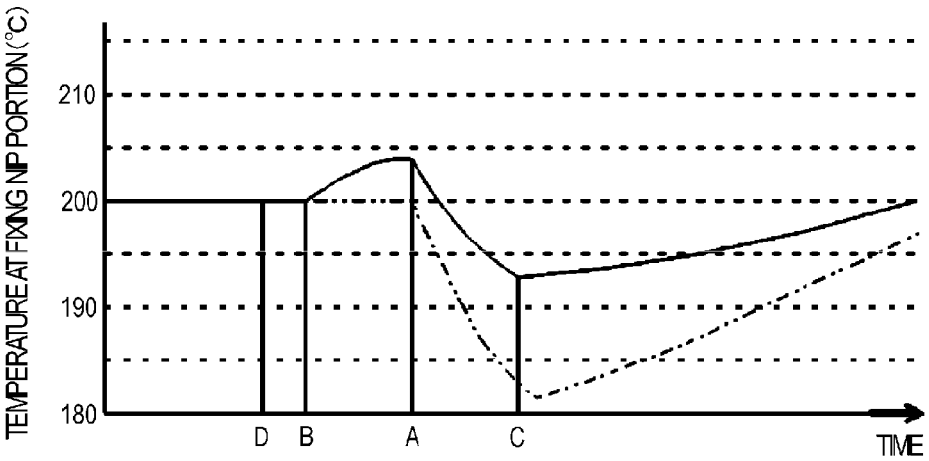

FIGS. 5A and 5B are graphs illustrating the change in the surface temperature of the fixing roller 101 before and after a thick recording material P passes through the fixing nip. FIG. 5A illustrates the change in the surface temperature of the fixing roller 101 when the external heating belt 105 is not provided, while FIG. 5B illustrates the change in the surface temperature of the fixing roller 101 when the external heating belt 105 is provided. In FIGS. 5A and 5B, the axis of the abscissa represents time (second), while the axis of the ordinate represents the temperature at the fixing nip portion (the surface temperature of the fixing roller 101 at the fixing nip portion N) (° C.). The conveyance speed of the recording material P is 500 mm/sec, and the recording material P with 250 g/m2 is used. An experiment was conducted under the conditions described above.

In FIG. 5A, a time A is a time taken for the recording material P to enter the fixing nip portion N. A time E is a starting time of a thermal response of the fixing heater. As illustrated in FIG. 5B, when the recording material P proceeds to the fixing nip portion N (time A) in case where the external heating belt 105 is not provided, heat is absorbed by the recording material P, so that the surface temperature of the fixing roller 101 is lowered (time A–time E). When the thermal response of the fixing heater is started, the surface temperature of the fixing roller 101 increases to return (after the time E). The temperature drop of the fixing roller 101 becomes about 20° C., with the result that not only the reduction in gloss is produced, but also a low-temperature offset occurs, which causes a defective fixing.

In FIG. 5B, a time D is a time taken for the external heating belt 105 to abut against the fixing roller 101. A time B is a time when the point (portion) where the external heating belt 105 abuts against the fixing roller 101 reaches the fixing nip portion N at the beginning A time A is a time taken for the recording material P to proceed to the fixing nip portion N. A time C is a starting time of a thermal response of the fixing heater. As illustrated in FIG. 5B, when the external heating belt 105 is provided, the external heating belt 105 firstly abuts against the fixing roller 101 (time D). The point where the external heating belt 105 abuts against the fixing roller 101 reaches the fixing nip portion N (time B). The temperature of the fixing roller 101 starts to rise from the time B when the portion where the external heating belt 105 abuts against the fixing roller 101 reaches the fixing nip portion N at the beginning, in order to start the application of heat to the fixing roller 101 by the external heating belt 105 before the recording material P reaches the fixing nip portion N. The temperature of the fixing roller 101 keeps on increasing before the time A when the recording material P reaches the fixing nip portion N. In this case, the controller 200 controls the conveyance timing of the recording material P in order that the leading end of the recording material P reaches the fixing nip portion N during when the external heating belt 105 abuts against the fixing roller 101 to increase the temperature of the fixing roller 101 at the fixing nip portion N (during the period of the time B–the time A).

When the recording material P reaches the fixing nip portion N, the heat is absorbed by the recording material P, so that the temperature drop of the fixing roller 101 is started (the time A). Thereafter, when the thermal response of the fixing heater is started, the surface temperature of the fixing roller 101 increases to return (after the time C). In this case, the temperature drop of the fixing roller 101 is suppressed to be about 7° C., since the external heating belt 105 applies heat to the fixing roller 101. As a result, the temperature drop of the fixing roller 101 becomes not more than 10° C., compared to the temperature of 200° C. of the fixing roller 101, while keeping productivity in image formation with high quality onto a plurality of recording materials P, whereby the variation in the surface temperature of the fixing roller 101 can be suppressed. The gloss change is suppressed to be about 15%, resulting in that it is found that high productivity can be achieved with high image quality.

Figure 6:
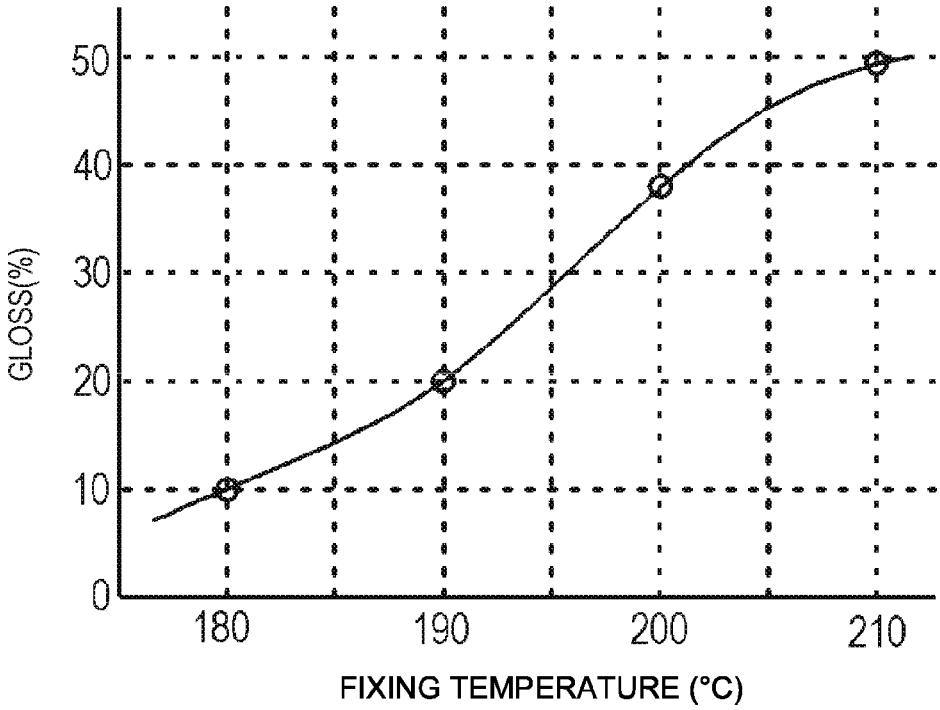
FIG. 6 is a graph illustrating a change (roughness on the surface of an image) in a gloss (gloss level) of a recording material corresponding to a temperature change at the fixing nip portion in the fixing apparatus.

FIG. 6 is a graph illustrating the change (roughness on the surface of the image) in gloss (gloss level) of the recording material P corresponding to the temperature change at the fixing nip portion N of the fixing apparatus 9. As illustrated in FIG. 6, even in the state in which the defective fixing does not occur, the temperature at the fixing nip portion N is lowered from 200° C. by about 20° C., so that the gloss is reduced to be about 10% from 40%, when the external heating belt 105 is not provided (see FIGS. 5A and 5B). When the gloss variation is great as described above, the recording material P subject to the fixing operation cannot have a high image quality.

On the other hand, when the external heating belt 105 is provided (see FIG. 5B), the temperature at the fixing nip portion N of the original fixing roller 101 is lowered to be 193° C. from 200° C., so that the gloss is reduced to be 25% from 40%. The range of the gloss variation is 15%, so that the recording material P subject to the fixing operation can have a high image quality. Accordingly, it is preferable that the gloss variation is set to be not more than 20% as a range in order to form a high-quality image.

The image forming speed (fixing speed) is extremely high. On the other hand, since the external heating belt 105 is used as the external heating member for compensating for the temperature drop of the fixing roller 101 by the recording material P or the toner, a continuous image forming job in which the plurality of recording materials P is continuously fed to the fixing nip portion N for performing the fixing operation can be executed.

Since the external heating belt 105 is for compensating the drop of the temperature of the fixing roller 101, the controlled temperature thereof is set to be higher than the controlled temperature of the fixing roller 101. If the time from when the external heating belt 105 abuts against the fixing roller 101 to when the recording material P passes through the fixing nip portion N is too long, the surface temperature of the fixing roller 101 is excessively increased, which might cause defective fixing. Therefore, it is controlled such that the leading end of the recording material P starts to proceed to the fixing nip portion N within a predetermined time after the external heating belt 105 abuts against the fixing roller 101. The period within the predetermined time is, for example, within the time before the temperature of the outer surface of the fixing roller 101 at the fixing nip portion N is increased more than the controlled temperature (200° C.) by a predetermined temperature (specifically, 10° C.) by the external heating belt 105.

The increased temperature of 10° C. is the temperature corresponding to the unevenness in the gloss, so that it is not limited to this numerical value, and it may be set to be an appropriate numerical value depending upon the individual apparatus. Similarly, the temperature drop of 10° C. is the temperature corresponding to the unevenness in the gloss, so that it is not limited to this numerical value, and it may be set to be an appropriate numerical value depending upon the individual apparatus.

In the first embodiment, the external heating belt 105 abuts against the fixing roller 101 and retracts the external heating belt 105 from the fixing roller 101 corresponding to the timing of conveying the recording material P (the timing when the recording material P proceeds to the fixing nip portion N between the fixing roller 101 and the pressure roller 102). Accordingly, the timing of starting the abutting of the external heating belt 105 against the fixing roller 101 is controlled with the image writing timing (the timing of starting the exposure to the photosensitive drum) of the fourth image forming portion (image forming station) Ud at the most downstream side being defined as a trigger (being defined as a reference timing).

After the fixing process to the last recording material P in the continuous image forming job to the plurality of recording materials P is completed, the external heating belt 105 is controlled to be retracted from the fixing roller 101 as soon as possible. Since the temperature of the external heating belt 105 is set to be higher than the temperature of the fixing roller 101, trouble can occur if the temperature of the fixing roller 101 increases too much when the separation of the external heating belt 105 is delayed after the completion of the fixing process. However, when the separating operation of the external heating belt 105 is started, the fixing roller 101 and the external heating belt 105 are immediately separated from each other due to the presence of the belt holding roller 55 serving as the "restricting portion", whereby the temperature rise of the fixing roller 101 can be kept low.

The fixing apparatus 100 includes a first motor M that is a "first rotation drive portion" for rotating and driving the external heating belt 105, and a second motor M2 serving as a "second rotation drive portion" for rotating and driving the fixing roller 101. Additionally, the controller 200 controls the rotation drive of the first motor M1 and the rotation drive of the second motor M2 in such a manner that the peripheral velocity of the external heating belt 105 and the peripheral velocity of the fixing roller 101 become equal to each other when the separation/contact unit 170*b* allows the external heating belt 105 to be in contact with the fixing roller 101. In order to achieve this, at least one of the first heating roller 103 and the second heating roller 104 is driven by an unillustrated motor in the state in which the external heating belt 105 is separated from the fixing roller 101 so as to rotate the external heating belt 105 with the surface velocity of the fixing roller 101. With this, sliding friction between the external heating belt 105 and the fixing roller 101 is eliminated, when the external heating belt 105 abuts against the fixing roller 101, whereby sliding-friction damage between the external heating belt 105 and the fixing roller 101 can further be reduced.

Second Embodiment

Figure 7A:
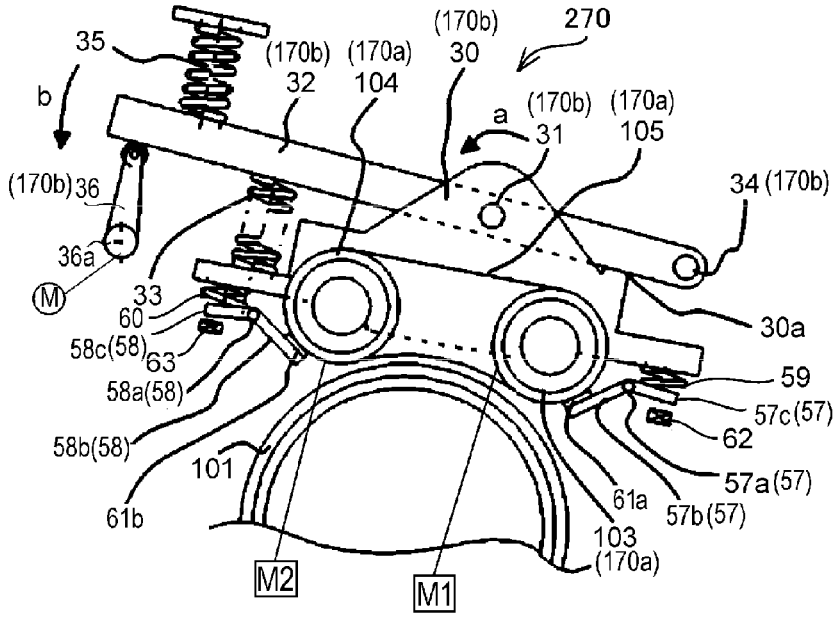
FIGS. 7A and 7B are sectional views illustrating a configuration of a heating and canceling mechanism provided in a fixing apparatus according to a second embodiment.

FIG. 7A is a sectional view illustrating a configuration of a heating and canceling mechanism 270 provided to a fixing apparatus according to the second embodiment. The components in the heating and canceling mechanism 270 in the second embodiment that are same as those in the heating and canceling mechanism 170 in the first embodiment are identified by the same numerals, and the description will appropriately be skipped. Even the second embodiment can be applied to the image forming apparatus that is the same as that in the first embodiment, so that the description of the image forming apparatus will be skipped. The points of difference between the heating and canceling mechanism 270 in the second embodiment and the heating and canceling mechanism 170 in the first embodiment are as described below.

Specifically, a first support arm 57 and a second support arm 58 serving as the "restricting portion" respectively to support the first heating roller 103 and the second heating roller 104 as abutting against the first heating roller 103 and the second heating roller 104 from the side of the fixing roller 101. Specifically, the first support arm 57 and the second support arm 58 function as "roller support members". In this case, the first support arm 57 and the second support arm 58 perform their supporting function through the external heating belt 105 in order to keep the distance between the first heating roller 103 and the second heating roller 104. The first support arm 57 and the second support arm 58 support the first heating roller 103 and the second heating roller 104 in such a manner that the shape of the external heating belt 105 is kept to be the nip shape.

The reason for the configuration described above is as described below. When it is intended to further enhance the responsiveness of the external heating belt 105, a configuration is needed in which the heat of the first heating roller 103 and the second heating roller 104 are instantaneously transmitted to the fixing roller 101. In order to satisfy this need, it is necessary to reduce the thickness of the external heating belt 105. When the thickness of the external heating belt 105 is reduced, the external heating belt 105 buckles with the belt holding roller 55 in the first embodiment, since the belt holding roller 55 holds only both ends of the belt in the longitudinal direction. Therefore, the external heating belt 105 cannot keep the shape of the abutment nip portion Ne when it is separated from the fixing roller 101. The second embodiment aims to solve the above-mentioned problem.

In the heating and canceling mechanism 270, both ends of the first heating roller 103 and the second heating roller 104 are supported by the support frame 30, so as to freely rotate, by a bearing through an unillustrated insulating bush and bearing. A flange of the insulating bush is formed to be greater than the outer diameter of the first heating roller 103 and the second heating roller 104, whereby it functions as a movement restricting member of the external heating belt 105 in the longitudinal direction of the roller. Both ends at the near side and at the far side of the support frame 30 are supported by the arm 32 by the support shaft 31 so as to be capable of freely swinging. A force is applied to the support frame 30 so as to swing in the direction of an arrow a about the support shaft 31 by the spring 33, wherein the first heating roller 103 and the second heating roller 104 are separated from the fixing roller 101. In the state illustrated in FIG. 7A, the abutting portion 30*a* provided to the support frame 30 abuts against the arm 32. The arm 32 is provided so as to be capable of swinging about a support shaft 34 with respect to a frame of the fixing apparatus not illustrated. The heating/pressing spring 35 is provided at the free end of the arm 32, wherein the spring 35 applies force to allow the arm 32 to swing in the direction of b about the support shaft 34.

As illustrated in FIG. 7A, the fixing apparatus includes the fixing roller 101 that serves as a "fixing member" to fix a toner image onto the recording material P, and the pressure roller 102 that serves as a "pressure member" to form a nip portion with the fixing roller 101 and apply pressure to the recording material P. The fixing apparatus includes, above the fixing roller 101, the heating unit 170*a* serving as an "external heating portion", a separation/contact unit 170*b* serving as a "separation/contact portion", and the first support arm 57 and the second support arm 58 serving as a "restricting portion".

The heating unit 170*a* serving as the "external heating portion" includes the external heating belt 105, and the first heating roller 103 and the second heating roller 104, which are the "two rollers" around which the external heating belt 105 is looped. Although described later, the separation/contact unit 170*b* serving as the "separation/contact portion" includes the support frame 30, the arm 32, the heating/pressing spring 35, the spring 33, the pressure-canceling arm 36, and the like.

The first support arm 57 and the second support arm 58 serving as the "restricting portion" respectively support the first heating roller 103 and the second heating roller 104 by abutting against the first heating roller 103 and the second heating roller 104, respectively, from the side of the fixing roller 101. In this case, the first support arm 57 and the second support arm 58 perform their support function through the external heating belt 105 in order to keep the distance between the first heating roller 103 and the second heating roller 104. Since the first support arm 57 and the second support arm 58 support the first heating roller 103 and the second heating roller 104, respectively, the shape of the external heating belt 105 is kept to be the nip shape. When the external heating belt 105 is in contact with (abuts against) the fixing roller 101 by the drive of the separation/contact unit 170*b*, the first support arm 57 and the second support arm 58 serving as the "restricting portion" are separated from the external heating belt 105. The external heating belt 105 has an offset restricting plate that restricts the position of the rotation of the external heating belt 105 at both ends thereof in the longitudinal direction, wherein the first support arm 58 and the second support arm 58 may be arranged at the position opposite to the offset restricting plate.

The first support arm 57 has a support portion 57*b* that supports the first heating roller 103, a pressed portion 57*c* that is pressed by a pressure spring 59, and a shaft 57*a* by which the support portion 57*b* and the pressed portion 57*c* are supported. The second support arm 58 has a support portion 58*b* that supports the second heating roller 104, a pressed portion 58*c* that is pressed by a pressure spring 60, and a shaft 58*a* by which the support portion 58*b* and the pressed portion 58*c* are supported.

The external heating belt 105 is nipped between by the heating roller 103 and the first support arm 57 provided to the support frame 30 upon the separation. The external heating belt 105 is nipped between the heating roller 104 and the second support arm 58 provided to the support frame 30 so as to be stretched. When the external heating belt 105 and the fixing roller 101 are separated from each other, the external heating belt 105 is nipped between the first heating roller 103 and the second heating roller 104, and the first support arm 57 and the second support arm 58 provided to the support frame 30. With this configuration, the external heating belt 105 can keep the shape of the abutment nip portion Ne in the separated state. The first and second support arms 57 and 58 can freely swing about the shafts 57*a* and 58*a*, respectively, with respect to the support frame 30, wherein the pressure springs 59 and 60 press the external heating belt 105.

The support portion 57*b* of the first support arm 57 is a plate-like member that abuts against the first heating roller 103. The first support arm 57 has a pat 61*a*, which is an "elastic member", on the plate surface of the support portion 57*b*. The support portion 58*b* of the second support arm 58 is a plate-like member that abuts against the second heating roller 104. The second support arm 58 has a pat 61*b*, which is an "elastic member", on the plate surface of the support portion 58*b*. This is for not damaging the external heating belt 105 by the first and second support arms 57 and 58. The pats 61*a* and 61*b* are provided at the contact portion between the first and second support arms 57 and 58 and the external heating belt 105. The pats 61*a* and 61*b* are made of a non-woven cloth made of an aramid fiber having heat resistance property. The pats 61*a* and 61*b* press all over the belt in the longitudinal direction. By virtue of this configuration, even in the configuration in which a flexible belt, e.g., a thin (30 μm) belt made of a resin (polyimide) is used, the external heating belt 105 can be separated as keeping the nip shape formed with the fixing roller 101. Since the shape of the external heating belt 105 can be kept to be the shape of the abutment nip portion Ne, the retracting amount of the external heating belt 105 from the fixing roller 101 can be set to be small.

Figure 7B:
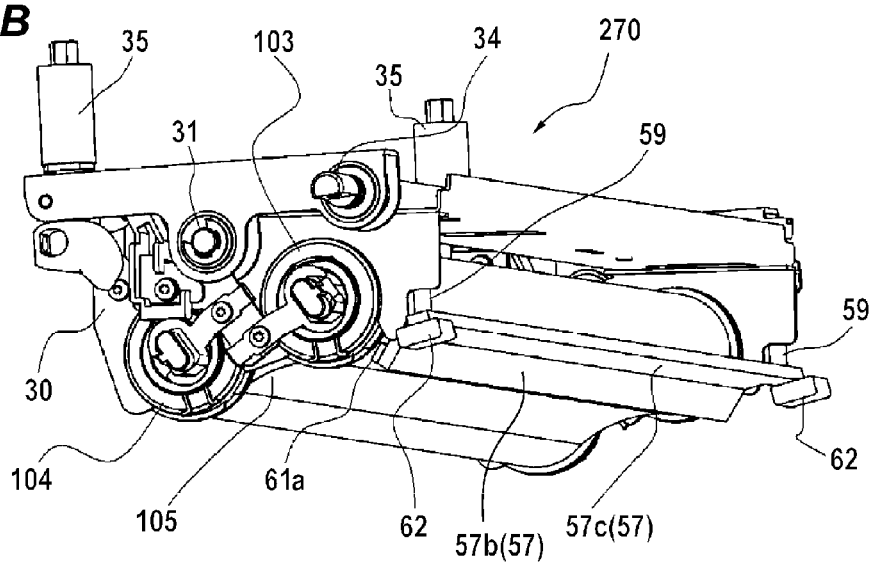

FIG. 7B is a perspective view illustrating the configuration of the heating and canceling mechanism 270. As illustrated in FIG. 7B, the first support arm 57 extends along the width direction of the external heating belt 105. In particular, the support portion 57*b* of the first support arm 57 extends along the width direction of the external heating belt 105. The first support arm 57 is arranged at the portion obliquely below the first heating roller 103, and at a position that is not between the first heating roller 103 and the fixing roller 101. The following factor is considered to be one of the reasons why the first support arm 57 is arranged parallel all over the external heating belt 105 in the width direction. Specifically, since the first support arm 57 is arranged at a portion obliquely below the first heating roller 103, it does not hinder the contact and the separation between the first support arm 57 and the fixing roller 101.

Similarly, the second support arm 58 extends along the width direction of the external heating belt 105. In particular, the support portion 58*b* of the second support arm 58 extends along the width direction of the external heating belt 105. The second support arm 58 is arranged at the portion obliquely below the second heating roller 104, and at a position that is not between the second heating roller 104 and the fixing roller 101. The following factor is considered to be one of the reasons why the second support arm 58 is arranged parallel all over the external heating belt 105 in the width direction. Specifically, since the second support arm 58 is arranged at a portion obliquely below the second heating roller 104, it does not hinder the contact and the separation between the second support arm 58 and the fixing roller 101.

Figure 8:
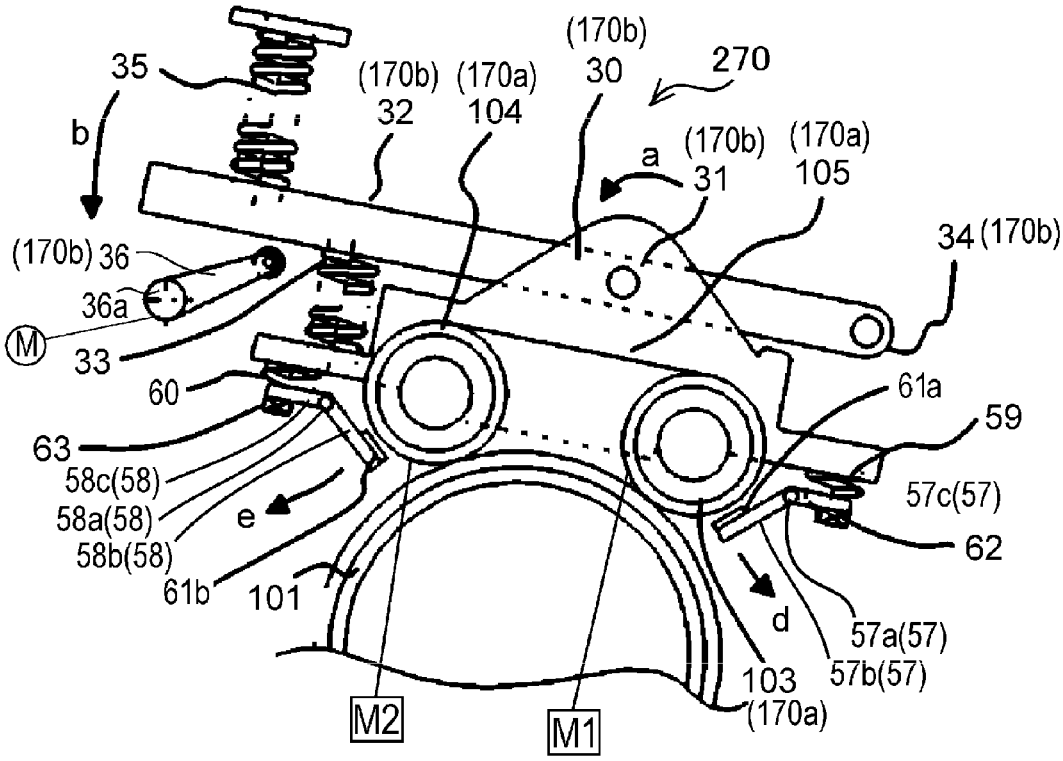
FIG. 8 is a sectional view illustrating a configuration of a heating and canceling mechanism.
Figure 9:
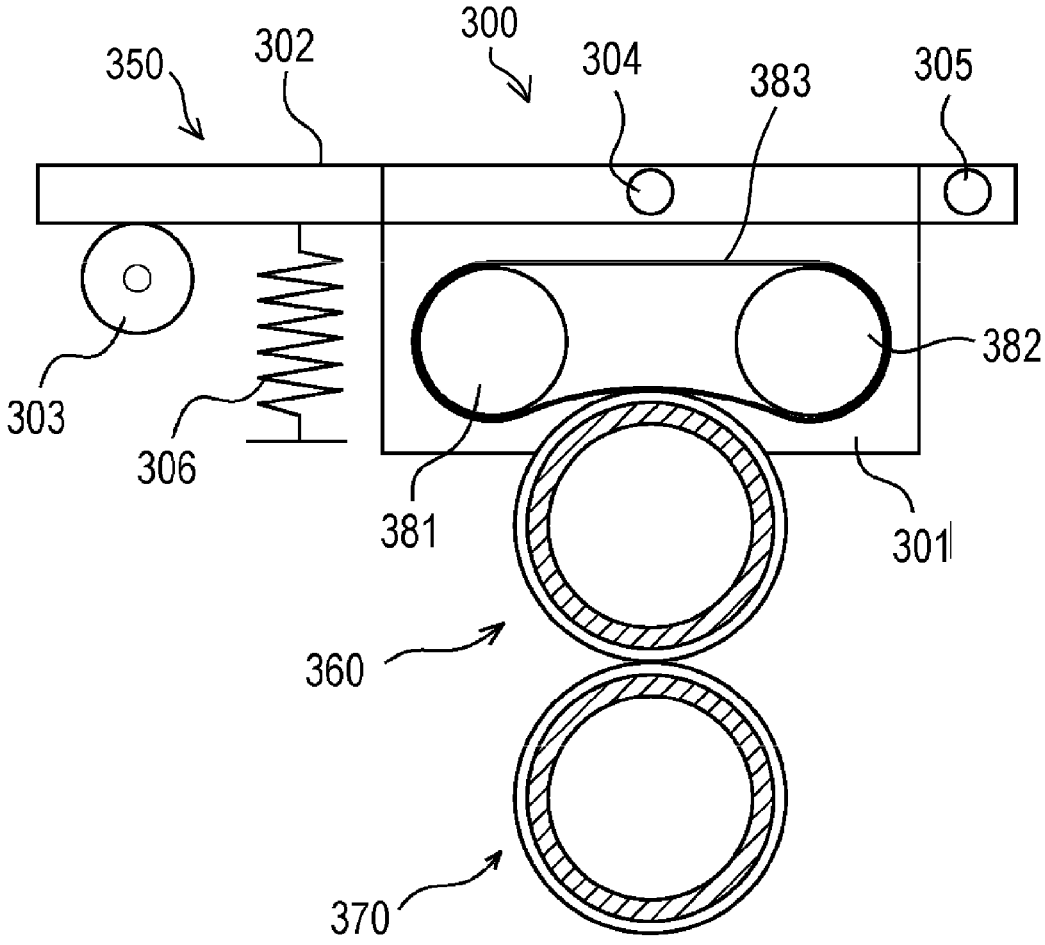
FIG. 9 PRIOR ART
FIG. 9 is a sectional view illustrating a configuration of a conventional heating and canceling mechanism.

FIG. 8 is a sectional view illustrating a configuration of the heating and canceling mechanism 270. In the state in which the external heating belt 105 abuts against the fixing roller 101 as illustrated in FIG. 8, the external heating belt 105 is pressed against the fixing roller 101 by the first heating roller 103 and the second heating roller 104 due to the heating/pressing spring 35 and the spring 33. The first heating roller 103 and the second heating roller 104 are in pressed contact with the fixing roller 101 with a total pressure of about 98 N (about 10 kg), and the external heating belt 105 rotates with the rotation of the fixing roller 101. The abutment nip portion Ne (contact length) between the external heating belt 105 and the fixing roller 101 can be formed.

In the state in which the external heating belt 105 abuts against the fixing roller 101 as illustrated in FIG. 8, the support arms 57 and 58 swing in the directions of d and e about the shafts 57*a* and 58*a* against the biasing force of the pressure springs 58 and 59 by stoppers 62 and 63 provided to the fixing frame. When the support arms 57 and 58 swing, the pats 61*a* and 61*b* provided to the support arms 57 and 58 are separated from the external heating belt 105, whereby the external heating belt 105 can rotate with the rotation of the fixing roller 101.

As described above, even in case where it is intended to further enhance the responsiveness of the external heating belt 105, the external heating belt 105 can keep the shape of the abutment nip portion Ne when it is separated from the fixing roller 101, which means the effect same as that in the first embodiment can be obtained.

The pressure-canceling arm 36 of the separation/contact unit 170*b*, the first support arm 57 and the second support arm 58 are driven by the driving force of the motor M serving as a "swing portion (swing apparatus)" that is the same "driving device".

According to the fixing apparatus in the first embodiment and the second embodiment, the restricting portion supports the heating unit 170*a* in order that the external heating belt 105 keeps the shape of the abutment nip portion Ne, when the external heating belt 105 is separated from the fixing roller 101 by the drive of the separation/contact unit 170*b*. Accordingly, when the separation/contact unit 170*b* allows the external heating belt 105 to be in contact with the fixing roller 101, the whole of the external heating belt 105 can almost simultaneously be brought into contact with the fixing roller 101. Therefore, the phenomenon in which the external heating belt 105 and the fixing roller 101 are in sliding friction with each other can be prevented. As a result, a the likelihood of producing a defective image caused by sliding-friction damage is reduced, whereby the durability life of the external heating belt 105 and the fixing roller 101 is increased.

Since the external heating belt 105 keeps the nip shape, the external heating belt 105 can immediately be brought into contact with and separated from the fixing roller 101, compared to the case in which the external heating belt 105 does not keep the nip shape. Accordingly, the temperature of the fixing roller 101 is easily adjusted. Consequently, the gloss is precisely adjusted.

Further, the external heating belt 105 can be separated from the fixing roller 101 immediately after the last recording material P passes through the fixing roller 101 after the job, in particular. Accordingly, an excessive temperature change of the fixing roller 101 can be prevented. Consequently, the fixing roller 101 can be returned to be a predetermined temperature for the stand-by state immediately after the job. As a result, the next job can be accepted fast.

The external heating belt 105 keeps the nip shape when it is in contact with and separated from the fixing roller 101. Accordingly, a space needed for the contact and separation of the external heating belt 105 can be saved. Further, the moving distance of the external heating belt 105 can be shortened. As a result, the configuration of the separation/contact unit 170*b* can be simplified.

In the fixing apparatus in the first embodiment, the belt holding roller 55 supports the external heating belt 105 as abutting against the external heating belt 105 from the side of the fixing roller 101. Therefore, the external heating belt 105 keeps the nip shape corresponding to the shape of the fixing roller 101. As a result, the configuration for keeping the nip shape can be simplified.

In the fixing apparatus according to the first embodiment, the belt holding roller 55 is a roller-like member that abuts against the external heating belt 105. Therefore, when the external heating belt 105 is in contact with the fixing roller 101, the damage caused by sliding friction can be reduced, whereby the deterioration of the external heating belt 105 can be prevented by the belt holding roller 55.

In the fixing apparatus according to the second embodiment, the first support arm 57 and the second support arm 58, which serve as the "restricting portion", respectively support the first heating roller 103 and the second heating roller 104 by abutting against the first heating roller 103 and the second heating roller 104 from the side of the fixing roller 101. Specifically, the first support arm 57 and the second support arm 58 function as "roller support members". In this case, the first support arm 57 and the second support arm 58 perform their support function through the external heating belt 105 in order to keep the distance between the first heating roller 103 and the second heating roller 104. Therefore, the external heating belt 105 keeps the nip shape corresponding to the shape of the fixing roller 101. Consequently, even in the configuration in which a flexible belt, e.g., a thin belt made of a resin, is used, the external heating belt 105 can be separated and keep the nip shape formed with the fixing roller 101, which prevents the external heating belt 105 from being in contact with the fixing roller 101.

In the fixing apparatus according to the second embodiment, the first support arm 57 and the second support arm 58 are plate-like members that abut against the first heating roller 103 and the second heating roller 104, respectively. Therefore, the external heating belt 105 is supported at two portions, so that the external heating belt 105 is stabilized.

In the fixing apparatus according to the second embodiment, the first support arm 57 and the second support arm 58 include the pats 61*a* and 61*b*, respectively, on the plate surface. Accordingly, when the external heating belt 105 and the fixing roller 101 are in contact with or separated from each other, the generation of sliding-friction damage caused by the sliding friction between the external heating belt 105 and the belt holding roller 55 can be prevented.

In the fixing apparatuses according to the first and second embodiments, the "restricting portion" is separated from the external heating belt 105 when the separation/contact unit 170*b* allows the external heating belt 105 to be in contact with the fixing roller 101. Therefore, during the time when the fixing roller 101 performs the fixing operation, the phenomenon in which the external heating belt 105 is in sliding friction with the "restricting portion" can be reduced. Accordingly, the deterioration of the external heating belt 105 caused by the belt holding roller 55 is prevented. Further, the state of the fixing operation and the stand-by state can surely be changed.

In the fixing apparatuses according to the first and second embodiments, the rotation drives of the first motor M1 and the second motor M2 are controlled such that the peripheral velocity of the external heating belt 105 and the peripheral velocity of the fixing roller 101 become equal to each other when the separation/contact unit 170*b* allows the external heating belt 105 to be in contact with the fixing roller 101. Therefore, the sliding friction between the external heating belt 105 and the fixing roller 101 can be reduced. Consequently, the generation of sliding-friction damage on the external heating belt 105 and the fixing roller 101 can be prevented.

In the fixing apparatuses according to the first and second embodiments, the pressure-canceling arm 36 and the belt holding roller 55 of the separation/contact unit 170*b* are driven by the driving force of the same motor M. The pressure-canceling arm 36 of the separation/contact unit 170*b*, the first support arm 57 and the second support arm 58 are driven by the driving force of the same motor M. Accordingly, the number of motors M is reduced, whereby the configuration can be simplified.

In the description of the embodiments, the external heating belt 105 serving as the external heating member can be abutted against or retracted from the fixing roller 101 serving as the pair of fixing members, but the invention is not limited thereto. As another configuration, the external heating belt 105 may be configured to be capable of abutting against or retracting from the pressure roller 102 serving as the pair of fixing members.

Although the pair of fixing members includes two rollers which are the fixing roller 101 and the pressure roller 102, it is needless to say that a belt-like member may be used instead of the roller. As described above, according to the present invention, the restricting portion supports the external heating portion in such a manner that the external heating portion keeps the shape of the nip portion, when the external heating belt is separated from the fixing member by the drive of the separation/contact portion. Accordingly, when the separation/contact portion allows the external heating belt to be in contact with the fixing member, the whole of the external heating belt can be brought into contact with the fixing member almost simultaneously. Consequently, the phenomenon in which the external heating belt and the fixing member are in sliding friction with each other can be suppressed. As a result, the likelihood of producing a defective image caused by the sliding-friction damage is reduced, whereby the durability life of the external heating belt and the fixing member is increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-282851, filed Dec. 14, 2009, which is hereby incorporated by reference herein in its entirety.

What is claimed is:

1. A fixing apparatus comprising:

a fixing member configured to fix a toner image onto a recording material;

a pressure member configured to press the fixing member to form a nip portion by which the recording material is nipped and conveyed;

an external heating mechanism including an external heating belt configured to heat the fixing member by contacting an outer surface of the fixing member;

a retraction mechanism configured to retract the external heating mechanism from the fixing member in a stand-by state; and a restricting member configured to restrict the external heating belt such that the external heating belt is not in contact with the fixing member when the external heating mechanism is retracted from the fixing member by the said retraction mechanism.

2. The fixing apparatus according to claim 1, wherein the restricting member is a belt support member which supports the external heating belt by abutting against the external heating belt from the side of the fixing member.

3. The fixing apparatus according to claim 1, wherein the belt support member is a roller-like member which abuts against the external heating belt.

4. The fixing apparatus according to claim 1, wherein the external heating mechanism includes two rollers around which the external heating belt is looped, the restricting member is two roller support members which respectively support the two rollers through the external heating belt by abutting against the two rollers from the side of the fixing member in such a manner that the distance between two rollers is maintained.

5. The fixing apparatus according to claim 4, wherein each of the two roller support members is a plate-like member which abuts against one of the two rollers.

6. The fixing apparatus according to claim 4, wherein each of the two roller support members includes an elastic member on its plate surface.

7. The fixing apparatus according to claim 1, wherein the restricting member is separated from the external heating belt, when the retraction mechanism allows the external heating belt to be in contact with the fixing member.

8. The fixing apparatus according to claim 1, further comprising:

a first rotation drive portion configured to rotationally drive the external heating belt;

a second rotation drive portion configured to rotationally drive the fixing member; and a controller configured to control the driving of the retraction mechanism, wherein the controller controls the rotation drive of the first rotation drive portion and the second rotation drive portion in such a manner that the peripheral velocity of the external heating belt and the peripheral velocity of the fixing member become equal to each other, when the retraction mechanism allows the external heating belt to be in contact with the fixing member.

9. The fixing apparatus according to claim 1, wherein the retraction mechanism and the restricting member are driven by a driving force of the same driving device.

* * * * *